US008238587B2

(12) United States Patent
Yuasa et al.

(10) Patent No.: US 8,238,587 B2
(45) Date of Patent: Aug. 7, 2012

(54) ELECTRET CONDENSER MICROPHONE

(75) Inventors: Hideo Yuasa, Qingdao (CN); Hidenori Motonaga, Qingdao (CN)

(73) Assignee: Hosiden Corporation, Yao-shi (JP)

( * ) Notice: Subject to any disclaimer, the term of this patent is extended or adjusted under 35 U.S.C. 154(b) by 567 days.

(21) Appl. No.: 12/408,156

(22) Filed: Mar. 20, 2009

(65) Prior Publication Data

US 2009/0268930 A1 Oct. 29, 2009

(30) Foreign Application Priority Data

Apr. 25, 2008 (JP) ..... 2008-115255

(51) Int. Cl.
*H04R 25/00* (2006.01)

(52) U.S. Cl. ..... 381/176; 381/361

(58) Field of Classification Search ..... 381/174, 381/175, 176, 355, 361
See application file for complete search history.

(56) References Cited

U.S. PATENT DOCUMENTS

2005/0025328 A1* 2/2005 Song ..... 381/369

FOREIGN PATENT DOCUMENTS

| | | |
|---|---|---|
| JP | 58-207798 | 12/1983 |
| JP | 58-209299 | 12/1983 |
| JP | 59-105800 | 6/1984 |
| JP | 50-63026 | 10/1987 |
| JP | 2000-50393 | 2/2000 |
| JP | 2004-222091 A1 | 8/2004 |

OTHER PUBLICATIONS

Notification of Reasons for Refusal received from the Japanese Patent Office in counterpart application No. 2008-115255 dated Jan. 8, 2012 with English translation (6 pages).

* cited by examiner

*Primary Examiner* — Hoai V Pham
(74) *Attorney, Agent, or Firm* — Kratz, Quintos & Hanson, LLP

(57) ABSTRACT

The present invention provides an electret condenser microphone including a diaphragm, a frame adapted to affix the diaphragm to, and a backplate positionable inside the frame and opposite the diaphragm with a space reserved therebetween.

5 Claims, 3 Drawing Sheets

ELECTRET CONDENSER MICROPHONE

The present application claims priority under 35 U.S.C. §119 of Japanese Patent Application No. 2008-115255 filed on Apr. 25, 2008, the disclosure of which is expressly incorporated by reference herein in its entity.

TECHNICAL FIELD

The present invention relates to electret condenser microphones.

BACKGROUND ART

A conventional electret condenser microphone has a frame affixed with a vibratory diaphragm and a backplate disposed substantially parallel to the diaphragm with a predetermined space reserved therebetween, as disclosed in Japanese Unexamined Patent Publication No. 2000-050393 and Japanese Unexamined Patent Publication No. 2004-222091.

The frame and the backplate have substantially the same outer diameters and are vertically stacked one on top of the other. This structure is a bottleneck in reducing the thickness of the conventional electret condenser microphone.

SUMMARY OF INVENTION

The present invention was made in view of the foregoing circumstances. It is an object of the invention to provide an electret condenser microphone in which the frame and the backplate can be disposed at substantially the same level for reducing the thickness of the microphone.

In order to solve the above-mentioned problem, an electret condenser microphone according to the present invention includes a diaphragm, a frame adapted to affix the diaphragm to, and a backplate positionable inside the frame and opposite the diaphragm with a space reserved therebetween.

In such an electret condenser microphone, the backplate is disposed inside the frame. That is, the frame and the backplate are positioned substantially level with each other, making it possible to reduce the thickness of the microphone as compared with the conventional exemplary microphones.

The microphone may further include a spacer to be provided at a surface of the backplate opposite the diaphragm so as to reserve the space between the backplate and the diaphragm. In this case, it is desirable that the backplate as disposed inside the frame can press the diaphragm via the spacer.

The diaphragm, pressed by the backplate via the spacer, becomes tightened to gain tension. Accordingly, this aspect of the invention enables reduction of the space between the diaphragm and the backplate and improves sensitivity of the diaphragm. In addition, increased tension of the diaphragm helps to reduce undesirable variations in tension between diaphragms produced by affixing a film to a plurality of frames. More particularly, in mass production of the microphones, a plurality of frames may be affixed to a single film, which may be cut apart to form a plurality of diaphragms affixed to the respective frames. Although such diaphragms may vary in tension, this aspect of the invention can reduce the variations because each diaphragm is pressed by the backplate via the spacer.

In a case where the diaphragm is affixed to a first surface of the frame, it is desirable that the backplate be adapted to press the diaphragm via the spacer from the first surface side of the frame.

In this case, simply disposing the backplate and the spacer inside the frame allows the diaphragm to be pressed by the combined thickness of the backplate and spacer. This aspect of the invention provides a further advantage in improving tension on the diaphragm.

The microphone may further include a capsule for accommodating the frame. The capsule may have a protruded portion to be disposed inside the frame and to function as the backplate. In this case, the microphone having the backplate as the protruded portion of the capsule may be manufactured with reduced number of components and in less assembly man-hours, in comparison with a case of providing the backplate as a discrete component. Consequently, this aspect of the invention is advantageous in cost reduction.

Further, the capsule may accommodate the backplate as well as the frame. Such capsule may have a positioning means for positioning and holding the backplate.

Moreover, the capsule may accommodate the spacer in addition to the frame and the backplate. Such capsule may include a positioning means for positioning and holding the backplate as pressing the diaphragm.

The positioning means of either type makes it easy to position and hold the backplate, facilitating attachment of the backplate.

DESCRIPTION OF EMBODIMENTS

Embodiments of the present invention are described below.

First Embodiment

First, an electret condenser microphone according to a first embodiment of the present invention is described with reference to FIG. 1.

Figure 1:
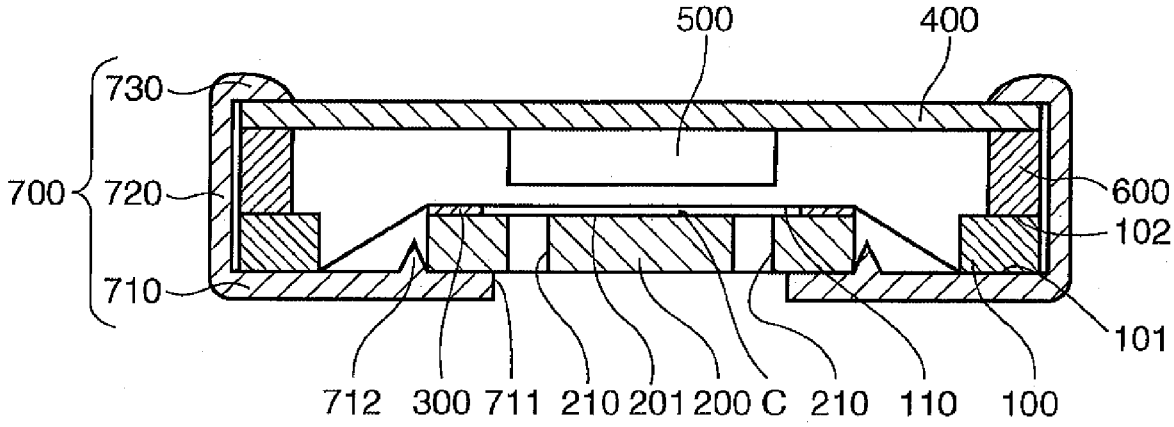
FIG. 1 is a schematic cross-sectional view of an electret condenser microphone according to a first embodiment of the present invention.

The electret condenser microphone as shown in FIG. 1 is a back electret condenser microphone. The electret condenser microphone includes a frame 100 having a diaphragm 110 affixed thereto, a backplate 200, a spacer 300, a printed circuit board (PCB) 400, a field-effect transistor (FET) 500, an electrically conductive ring 600, and a capsule 700 containing all the other components. Each component of the microphone will be described in detail below.

The frame 100 is a circular electrically conductive ring. The frame 100 is set on an electrically isolated portion (not shown) of a bottom plate 710 (to be described below) of the capsule 700.

The diaphragm 110 is made of a well-known metal thin film. The diaphragm 110 is affixed to a lower surface 101 (a first surface) of the frame 100 with conductive adhesive.

The ring 600 (gate ring) is an annular member having substantially the same outer diameter as that of the frame 100. The ring 600 is disposed on an upper surface 102 of the frame 100 and is interposed between the PCB 400 and the frame 100.

The PCB 400 is a well-known circular circuit board and is disposed above the frame 100. The PCB 400 has substantially the same outer diameter as that of the frame 100. The PCB 400 is provided with first and second conductive lines (not shown). The first conductive line contacts the ring 600, while connecting to a gate terminal of the FET 500 that is mounted at the center of a lower surface of the PCB 400. The second conductive line contacts a swaged portion 730 (to be described below) of the capsule 700 for connection with a ground terminal (not shown).

The spacer 300 is an insulative ring formed on the peripheral edge of an upper surface of the backplate 200. As described below, the spacer 300 is interposed between the diaphragm 110 and the backplate 200 so as to reserve a predetermined space C therebetween.

The backplate 200 is a circular conductive metal plate. The backplate 200 has an outer diameter that is smaller than the inner diameter of the frame 100 and a thickness that is substantially the same as the thickness of the frame 100. On the upper surface (the surface opposing the diaphragm) of the backplate 200, there is formed an electret layer 201, which may be a thin film of polymer such as fluorinated ethylene propylene (FEP).

The backplate 200 is disposed inside the frame 100. In this state, the backplate 200 presses the diaphragm 110 via the spacer 300 from below (from the first surface side of the frame) by the combined thickness of the backplate 200 and spacer 300. The space C (capacitor) having the thickness of the spacer 300 is thereby formed between the electret layer 201 on the backplate 200 and the diaphragm 110, while tightening the diaphragm 110 to apply tension thereto.

Additionally, the backplate 200 has a plurality of through holes 210 penetrating through the thicknesses of the backplate 200 and electret layer 201. These columnar through holes 210 connect a sound receiving aperture 711 (to be described below) in the capsule 700 with the space C between the backplate 200 and the diaphragm 110. That is, sound enters the capsule 700 from the sound receiving aperture 711, past the through holes 210 and into the space C to cause the diaphragm 110 to vibrate. The vibrations of the diaphragm produce changes in capacitance of the capacitor.

The capsule 700 is a substantially circular cup-shaped member formed by press-molding a conductive metal plate. The capsule 700 includes the bottom plate 710, a cylindrical peripheral wall 720 upstandingly provided on the outer peripheral edge of the bottom plate 710, and the swaged portion 730 provided at the leading end of the peripheral wall 720.

The bottom plate 710 is provided at its center with the sound receiving aperture 711 in a substantially circular shape. The bottom plate 710 further has a ring-shaped projection 712 (a positioning means) projecting upward along the periphery of the sound receiving aperture 711. The inner diameter of the projection 712 is slightly smaller than the outer diameter of the backplate 200. That is, the projection 712 is used to hold the backplate 200 in position on the bottom plate 710, whereby connection is established between the backplate 200 and the second conductive line of the PCB 400 via the capsule 700. Along the peripheral edge of the bottom plate 710 there is provided the electrically isolated portion (not shown), on top of which the frame 100 is placed.

The swaged portion 730 is an inwardly bent piece member. The distance between the lower surface of the swaged portion 730 and an upper surface of the bottom plate 710 is substantially equal to the total thickness of the PCB 400, the ring 600 and the frame 100. That is, the stacked frame 100, ring 600, and PCB 400 are held between the swaged portion 730 and the bottom plate 710.

The electret condenser microphone having the above-described structure is assembled in the following steps. First, the electret layer 201 of thin film is formed over the upper surface of the backplate 200 using a well-known film-forming method such as spin coating, sputtering, and chemical vapor deposition (CVD). The spacer 300 is then printed on the outer peripheral edge of the electret layer 201.

The backplate 200 is then inserted inside the projection 712 of the capsule 700, so that the backplate 200 is held in position by the projection 712 and is electrically connected to the capsule 700.

After that, the frame 100 with the diaphragm 110 affixed is set on the electrically isolated portion of the bottom plate 710 of the capsule 700, with the diaphragm 110 facing downward. It should be noted here that the backplate 200 and the spacer 300 thereon are placed inside the frame 100 from below, and that the diaphragm 110 is pressed from below by the spacer 300 on the backplate 200. As a result, the diaphragm 110 becomes tightened and gains tension. Simultaneously therewith, the space C is formed between the diaphragm 110 and the electret layer 201 on the backplate 200.

After that, the ring 600 and the PCB 400 with the FET 500 mounted thereon are stacked, in this order, on top of the frame 100. The ring 600 thus comes into contact with the first conductive line of the PCB 400, and the diaphragm 110 on the frame 100 is electrically connected with the gate terminal of the FET 500 by way of the ring 600 and the first conductive line of the PCB 400.

After that, the leading end of the peripheral wall 720 of the capsule 700 is bent inward. The bent portion becomes the swaged portion 730 to abut on the outer peripheral edge of the upper surface of the PCB 400. As a result, the frame 100, the ring 600, and the PCB 400 are held between the swaged portion 730 and the bottom plate 710. Simultaneously therewith, the swaged portion 730 comes into contact with the second conductive line of the PCB 400. The electret layer 201 on the backplate 200 is thus electrically connected to the ground terminal by way of the capsule 700 and the second conductive line of the PCB 400.

The electret condenser microphone assembled in the above steps allows sound to pass from the sound receiving aperture 711 of the capsule 700, through the through holes 210 and into the space C, thereby making the diaphragm 110 vibrate. The vibrations of the diaphragm 110 produce changes in capacitance of the capacitor. Changes in capacitance are fed as electrical signals to the FET 500, by way of the frame 100, the ring 600, and the first conductive line.

In such an electret condenser microphone, the backplate 200 is disposed inside the frame 100, i.e., substantially level with the frame 100. As such, the microphone may have an advantageously reduced thickness compared with the conventional exemplary microphones.

In addition, the backplate 200 is set inside the frame 100 and presses the diaphragm 110 affixed to the lower surface of the frame 100 via the spacer 300 from below by the combined thickness of the backplate 200 and spacer 300. By being pressed by the backplate 200 and the spacer 300, the diaphragm 110 becomes tightened and favorably gains tension. Consequently, it becomes possible to reduce the distance between the diaphragm 110 and the backplate 200—i.e., the height of the space C—from a conventional distance of 25-38 μm to around 10 μm, and also possible to improve sensitivity of the diaphragm 110. Increased tension of the diaphragm 110 helps to reduce undesirable variations in tension between diaphragms produced by affixing a film to a plurality of frames. More particularly, in mass production of the microphones, a plurality of frames may be affixed to a single film, which may be cut apart to form a plurality of diaphragms affixed to the respective frames. Although such diaphragms may vary in tension, the invention can reduce the variations because each diaphragm is pressed by the backplate via the spacer.

Second Embodiment

Figure 2:
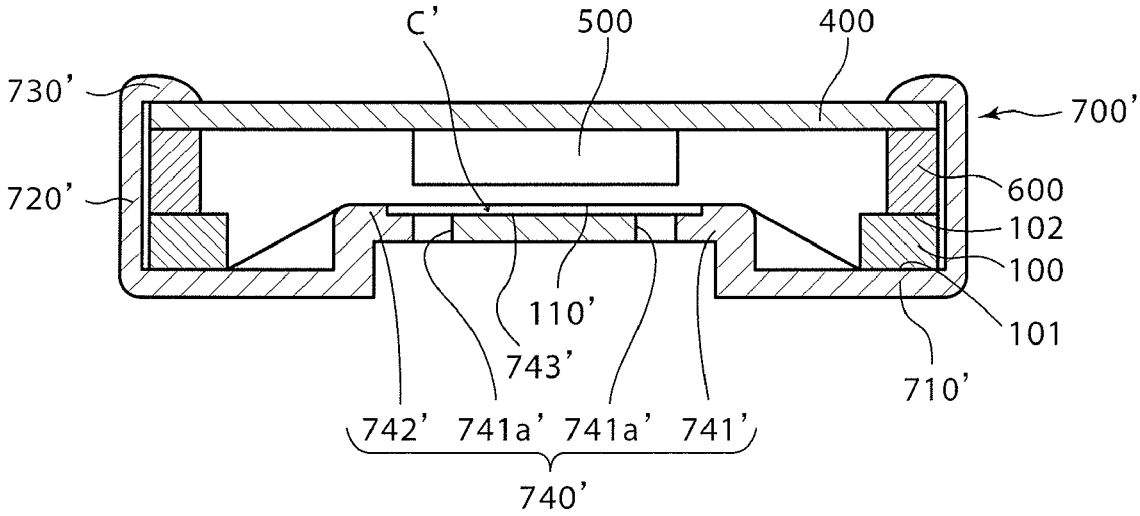
FIG. 2 is a schematic cross-sectional view of an electret condenser microphone according to a second embodiment of the present invention.

An electret condenser microphone according to a second embodiment of the present invention is described below with reference to FIG. 2. FIG. 2 is a schematic cross-sectional view of the electret condenser microphone according to the second embodiment of the present invention.

The electret condenser microphone as shown in FIG. 2 is different from the microphone of the first embodiment in that the backplate 200 and the spacer 300 are replaced by a backplate portion 741' and a spacer 742' of a protruded portion 740' of a capsule 700'. The differences will be elucidated below, and description on overlapping components will not be given to avoid redundancy. The reference numerals of the capsule and its subcomponents are distinguished from those of the first embodiment by adding the suffix "'".

The capsule 700' is a substantially circular cup-shaped member formed by press-molding a conductive metal plate. The capsule 700' includes a bottom plate 710', a cylindrical peripheral wall 720' upstandingly provided on the outer peripheral edge of the bottom plate 710', a swaged portion 730' provided at the leading end of the peripheral wall 720', and the upwardly protruded portion 740' formed at a central portion of the bottom plate 710' by performing drawing press.

The protruded portion 740' includes the backplate portion 741' in a substantially circular pedestal-like shape, and the spacer 742' protruded from the outer peripheral edge of a top plate (to be is described below) of the backplate portion 741'.

The spacer 742' is a ring-shaped protrusion and its upper surface to contact a diaphragm 110' is electrically isolated.

The backplate portion 741' has a cylindrical portion and the top plate that closes an upper opening of the cylindrical portion. The portion other than the outer peripheral edge of the top plate has an electret layer 743', which may be a thin film of polymer such as FEP.

The backplate portion 741' is set inside a frame 100. In this state, the backplate portion 741' presses the diaphragm 110' via the spacer 742' from below (from the first surface side of the frame) by the combined thickness of the backplate portion 741' and spacer 742'. Space C' (capacitor) having the thickness of the spacer 742' is thereby formed between the electret layer 743' on the backplate portion 741' and the diaphragm 110', while tightening the diaphragm 110' to apply tension.

The top plate of the backplate portion 741' is provided with a plurality of through holes 741*a*' penetrating through the top plate and the electret layer 743'. The columnar through holes 741*a*' serve as sound receiving apertures, which connect the outside of the capsule 700' with the space C' between the backplate portion 741' and the diaphragm 110'. The through holes 741*a*' allow sound to enter therethrough into the space C' to make the diaphragm 110' vibrate. The vibrations of the diaphragm 110' produce changes in capacitance of the capacitor.

The electret condenser microphone configured as above is assembled in the following steps. First, the frame 100 affixed with the diaphragm 110' is set on an electrically isolated portion of the bottom plate 710' of the capsule 700' with the diaphragm 110' facing downward. It should be noted here that the backplate portion 741' and the spacer 742' thereon are placed inside the frame 100 from below, and that the diaphragm 110' is pressed from below by the spacer 742' on the backplate portion 741'. As a result, the diaphragm 110' becomes tightened and gains tension. Simultaneously therewith, the space C' is formed between the diaphragm 110' and the electret layer 743' on the backplate portion 741'.

After that, a ring 600 and a PCB 400 with an FET 500 mounted thereon are stacked, in this order, on top of the frame 100. The ring 600 thus contacts a first conductive line of the PCB 400, and the diaphragm 110' on the frame 100 is electrically connected with a gate terminal of the FET 500 by way of the ring 600 and the first conductive line of the PCB 400.

After that, the leading end of the peripheral wall 720' of the capsule 700' is bent inward. The bent portion becomes the swaged portion 730' to abut on the outer peripheral edge of an upper surface of the PCB 400. As a result, the frame 100, the ring 600, and the PCB 400 are held between the swaged portion 730' and the bottom plate 710'. Simultaneously therewith, the swaged portion 730' comes into contact with a second conductive line of the PCB 400. The electret layer 743' on the backplate portion 741' is thus electrically connected with a ground terminal via the capsule 700' and the second conductive line of the PCB 400.

The electret condenser microphone assembled in the above steps allows sound to pass from the through holes 741*a*' in the capsule 700' into the space C', thereby making the diaphragm 110' vibrate. The vibrations of the diaphragm 110' produce changes in capacitance of the capacitor. Changes in the capacitance are fed as electrical signals to the FET 500, by way of the frame 100, the ring 600, and the first conductive line.

In such an electret condenser microphone, the backplate portion 741' is disposed inside the frame 100, i.e., substantially level with the frame 100. The microphone may have an advantageously reduced thickness compared with the conventional exemplary microphones.

In addition, the backplate portion 741' is set inside the frame 100 and presses the diaphragm 110' affixed to the lower surface 101 of the frame 100 from below via the spacer 742' by the combined thickness of the backplate portion 741' and spacer 742'. By being pressed by the back plate portion 741' and the spacer 742', the diaphragm 110' tightened and favorably gains tension. Consequently, it becomes possible to reduce the distance between the diaphragm 110' and the backplate portion 741'—i.e., the height of the space C'—from the conventional distance of 25-38 μm to around 10 μm, and also possible to improve sensitivity of the diaphragm 110'. Increased tension of the diaphragm 110' helps to reduce undesirable variations in tension between diaphragms produced by affixing a film to a plurality of frames. More particularly, in mass production of the microphones, a plurality of frames may be affixed to a single film, which may be cut apart to form a plurality of diaphragms affixed to the respective frames. Although such diaphragms may vary in tension, the invention can reduce the variations because each diaphragm is pressed by the backplate via the spacer.

Another advantageous feature of the second embodiment is that a portion of the capsule 700' (the protruded portion 740') forms the backplate portion 741' and the spacer 742'. The microphone allows it possible to reduce the number of components and assembly man-hours, in comparison with a case of providing the backplate portion 741' and the spacer 742' as discrete components. Consequently, the microphone is advantageous in cost reduction.

Figure 3:
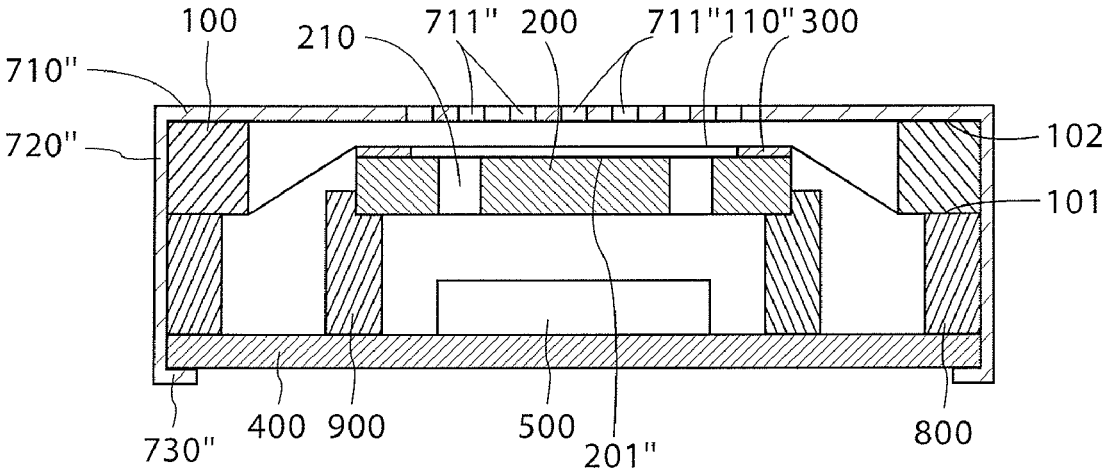
FIG. 3 is a schematic cross-sectional view of an electret condenser microphone according to a modification of the first embodiment of the present invention.

The above-described electret condenser microphones may be appropriately modified in design as described below, without departing from the scope of the present invention as set forth in the claims. FIG. 3 illustrates a modified electret condenser microphone of the first embodiment of the present invention in a schematic cross-sectional view.

The backplate 200 as disposed inside a frame 100 may or may not press a diaphragm 110". For example, the backplate 200 disposed inside a frame 100 may be placed to face the diaphragm 110" affixed to an upper surface of the frame 100 with a predetermined space provided between the diaphragm and the backplate. This arrangement may be applied to the backplate portion 741'. In this case, a spacer 300 or 742' may be or may not be provided in order to form the space.

The spacer 300 of the present invention is not limited to a ring-shaped one. For example, a plurality of spacers 300 may be arranged annularly on the backplate 200.

The spacer 742' is not limited to the above-described one formed by means of drawing press along the outer peripheral edge of the top plate of the backplate portion 741'. For example, as in the case of the spacer 300, the spacer 742' may be formed by printing an insulative layer on the outer peripheral edge of the top plate of the backplate portion 741'. In this case, a plurality of spacers may be arranged annularly on the backplate portion 741' as described above.

The protruded portion 740' of the second embodiment is made by performing drawing press on the central portion of the bottom plate 710' of the capsule 700'; however, the present invention is not limited thereto. For example, if the capsule 700' is a resin molded article as is described later, the protruded portion may be formed in the course of resin molding of the capsule 700'. In this case, a plurality of spacers may be formed annularly on the backplate portion.

The diaphragm 110, 110', 110" of either embodiment is provided on the lower surface of the frame 100. However, the diaphragm may be given appropriate pressure even if it is provided on the upper surface of the frame. More particularly, the diaphragm 110 of the first embodiment can be pressed if the combined thickness of the backplate 200 and the spacer 300 disposed inside the frame 100 is larger than the thickness of the frame 100. Similarly, the diaphragm 110' of the second microphone can be pressed if the combined thickness of the backplate portion 741' and the spacer 742' disposed inside the frame 100 (i.e., the height of the protruded portion 740') is larger than the thickness of the frame 100.

The board 400 may be disposed above the frame 100 as in the above embodiments but may also be disposed below the frame 100. The latter case is exemplified in a modified microphone as shown in FIG. 3, wherein an insulative ring 800 is interposed between the PCB 400 and the frame 100 so as to establish connection between the frame 100 and the second conductive line of the PCB 400 through the capsule 700". Meanwhile, the PCB 400 is provided thereon with a ring-shaped conductive retaining portion 900 for retaining the backplate 200 so as to establish connection between the backplate 200 and the first conductive line of the PCB 400 through the conductive retaining portion 900. It should be noted that the bottom plate 710" of the capsule 700" has a plurality of sound receiving apertures 711'. The modified microphone may have similar advantageous effects to the preferred first embodiment because the backplate 200 of the modification is also disposed inside the frame 100 and presses the diaphragm 110".

The capsule 700 of the above embodiments is made of a conductive metal but may be a molded article of insulative resin. In this case, conductive lines may be provided on the inner or outer surface of the capsule so as to establish connections as in the foregoing embodiments, particularly, between the backplate 200 and the PCB 400, or between the electret layer 743' on the backplate portion 741' and the PCB 400. As described above, the frame 100 and the PCB 400 may be connected via the conductive lines of the capsule 700.

The bottom plate 710 of the invention is not limited to the above-described one having the projection 712 as a positioning means for the backplate 200. That is, any type of positioning means may be adopted insofar as the means can position and hold the backplate 200. For example, the bottom plate 710 may be provided with a recess to fittingly receive the backplate 200.

The electret condenser microphones according to the foregoing embodiments are back electret condenser microphones in which the electret layer is provided on the surface of the backplate 200 or 741' opposite the diaphragm. However, the invention may be applied to a foil electret condenser microphone, in which the diaphragm 110 itself is made of a polymer film for use as electret.

Any modifications or changes may be made to the above-described components in shape, material and number as long as they can carry out similar functions to ones described above. Obviously, the components may not take circular (i.e., round) shapes as described above but may take polygonal (i.e., angular) shapes.

| REFERENCE SIGNS LIST | |
|---|---|
| 100 | Frame |
| 110 | Diaphragm |
| 200 | Backplate |
| 300 | Spacer |
| 700 | Capsule |
| 712 | Projection (Positioning means) |
| 700' | Capsule |
| 740' | Protruded portion |
| 741' | Backplate portion |
| 742' | Spacer |

CITATION LIST

Patent Literature 1: Japanese Unexamined Patent Publication No. 2000-050393

Patent Literature 2: Japanese Unexamined Patent Publication No. 2004-222091

The invention claimed is:

1. An electret condenser microphone comprising:

a frame, including an upper surface and a lower surface arranged to affix a diaphragm thereto;

a diaphragm, being affixed to the lower surface of the frame;

a backplate, including a backplate surface opposite the diaphragm and being disposed inside the frame such that the backplate surface is positioned above the lower surface of the frame; and a spacer, being provided on the surface of the backplate opposite the diaphragm and pressing the diaphragm so as to reserve a space between the backplate and the diaphragm.

2. The electret condenser microphone according to claim 1, further comprising a capsule for accommodating the frame, the capsule including a protruded portion, the protruded portion functioning as the backplate.

3. The electret condenser microphone according to claim 1, further comprising a capsule for accommodating the frame and the backplate, the capsule including positioning means for positioning and holding the backplate.

4. The electret condenser microphone according to claim 1, the backplate further including a back surface that is opposite the surface opposite the diaphragm, wherein the lower surface of the frame is flush with the back surface of the back plate.

5. The electret condenser microphone according to claim 4, further comprising a capsule, the capsule including a bottom plate, wherein the lower surface of the frame and the back surface of the backplate are in contact with the bottom plate.

* * * * *